US011504832B2

(12) United States Patent
Hua et al.

(10) Patent No.: US 11,504,832 B2
(45) Date of Patent: Nov. 22, 2022

(54) TOOL ADAPTER QUICK-RELEASE STRUCTURE

(71) Applicant: BASSO INDUSTRY CORP., Taichung (TW)

(72) Inventors: Chiang Hua, Taichung (TW); Fu-Chiang Huang, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 223 days.

(21) Appl. No.: 16/882,155

(22) Filed: May 22, 2020

(65) Prior Publication Data

US 2020/0368882 A1 Nov. 26, 2020

(30) Foreign Application Priority Data

May 23, 2019 (TW) ..... 108206470

(51) Int. Cl.
*B25B 23/00* (2006.01)
*B25B 15/00* (2006.01)

(52) U.S. Cl.
CPC ..... *B25B 23/0035* (2013.01); *B25B 15/001* (2013.01)

(58) Field of Classification Search
CPC ..... B25B 23/0035; B25B 15/001; B25B 23/0021; B23B 31/107; B23B 31/1071; B25D 17/088
USPC ..... 81/438, 439, 52
See application file for complete search history.

(56) References Cited

U.S. PATENT DOCUMENTS 4,629,375 A * 12/1986 Lieser ..... B25B 23/0035 408/239 R
4,828,277 A * 5/1989 De Bastiani ..... B23B 31/22 279/22
4,946,179 A * 8/1990 De Bastiani ..... B23B 31/226 279/46.7

(Continued)

FOREIGN PATENT DOCUMENTS

DE 202007001145 * 5/2007 ..... B25B 23/0021
DE 202008006820 * 11/2008 ..... B25B 15/001

(Continued)

OTHER PUBLICATIONS

Search Report dated Nov. 20, 2020 of the corresponding European patent application No. 20176151.7.

*Primary Examiner* — Orlando E Aviles
*Assistant Examiner* — Jason Khalil Hawkins
(74) *Attorney, Agent, or Firm* — Chun-Ming Shih; HDLS IPR Services

(57) ABSTRACT

A tool adapter quick-release structure includes an adapter and a locking mechanism. The adapter includes a seat portion and an engagement portion extended forward from the seat portion, and an installation hole formed to penetrate into the seat portion via the engagement portion. The locking mechanism includes a movable sleeve mounted onto the seat portion, an installation pin inserted into the movable sleeve and an elastic member abutted against the installation pin to push the movable sleeve axially, and the movable sleeve allowing a fixation member to penetrate through the seat portion to protrude outward inside the installation hole via push of the elastic member. The seat portion includes a repair hole corresponding to the installation pin and is connected to the installation hole.

10 Claims, 7 Drawing Sheets

(56) References Cited

U.S. PATENT DOCUMENTS

| | | | | |
|---|---|---|---|---|
| 5,398,946 | A * | 3/1995 | Quiring | B23B 31/1071 279/145 |
| 7,121,774 | B2 * | 10/2006 | Hirt | B25B 15/02 408/240 |
| 9,469,020 | B2 * | 10/2016 | Funk | B25B 23/0035 |
| 9,566,696 | B2 | 2/2017 | Yew et al. | |
| 2014/0097582 | A1 | 4/2014 | Wang | |
| 2015/0202751 | A1 | 7/2015 | Chen | |

FOREIGN PATENT DOCUMENTS

| | | | | |
|---|---|---|---|---|
| DE | 202012100860 | * | 5/2012 | B25B 23/0021 |
| EP | 1857210 A2 | * | 11/2007 | B23B 31/107 |

* cited by examiner

TOOL ADAPTER QUICK-RELEASE STRUCTURE

BACKGROUND OF THE INVENTION

Field of the Invention

The technical field relates to a handheld tool, in particular, to a tool adapter quick-release structure for changing various types of screwdrivers.

Description of Related Art

Presently, regardless whether it is an electric or manual handheld tool, to facilitate the use of the tool in various situations along with the function of tool parts replacement, particularly to perform the actions of fastening or removal of flat head, cross head or hexagonal screws etc., it is necessary to use a corresponding screwdriver.

However, in terms of the design, the output axle of a traditional handheld tool or power tool is typically not equipped with the function allowing users to perform removal, repair or replacement of parts individually. Consequently, after a long period of use of such tool, the internal components often require replacement and repair due to the problem of wear. For example, U.S. Pat. No. 9,566,696 discloses a handheld mechanical tool using a locking sleeve for fastening onto a tool socket, and the displacement of the locking sleeve is utilized to allow the installation of the tool of screwdriver etc. Such locking sleeve is formed by an operating element and a holding element. The holding element is associated to the tool socket via a spring element in order to allow the operating element to be fastened onto an outer side of the holding element via a threaded connection. Consequently, the operating element is able to push the two locking elements in a ball shape against the screwdriver tool, thereby achieving the effect of installation thereof. Nevertheless, since the operating element and the holding element adopt the threaded method of installation, it is not facilitated for removal. As a result, due to the design of inconvenient removal, traditional handheld tools typically have the drawback of requiring the replacement of a whole new set or inconvenient installation etc.

In view of above, the inventor seeks to improve and overcome the aforementioned drawback associated with the currently existing technology after years of research and development along with the utilization of academic theories in order to achieve a reasonable design of the present invention capable of effectively overcoming the aforementioned drawbacks.

SUMMARY OF THE INVENTION

A primary objective of the present invention is to provide a tool adapter quick-release structure in order to allow users to perform quick removal and to install components easily such that it is able to facilitate the operational needs.

To achieve the aforementioned objective, the present invention provides a tool adapter quick-release structure, comprising an adapter and a locking mechanism. The adapter includes a seat portion and an engagement portion extended forward from the seat portion, and an installation hole formed to axially penetrate into an internal of the seat portion via the engagement portion. The locking mechanism comprises a movable sleeve axially mounted onto an exterior of the seat portion, an installation pin radially inserted into the movable sleeve and an elastic member abutted against the installation pin to push the movable sleeve along an axial direction, and the movable sleeve configured to allow a fixation member to penetrate through the seat portion in order to be partially protruded outward at an internal of the installation hole via a push of the elastic member. In addition, the seat portion includes a repair hole formed corresponding to the installation pin, and the repair hole is connected to the installation hole.

DETAILED DESCRIPTION OF THE INVENTION

The following provides a detailed technical content of the present invention along with the accompanied drawings. However, it shall be understood that the accompanied drawings are provided for reference and illustration purposes only such that they shall not be used to limit the scope of the present invention.

Figure 1:
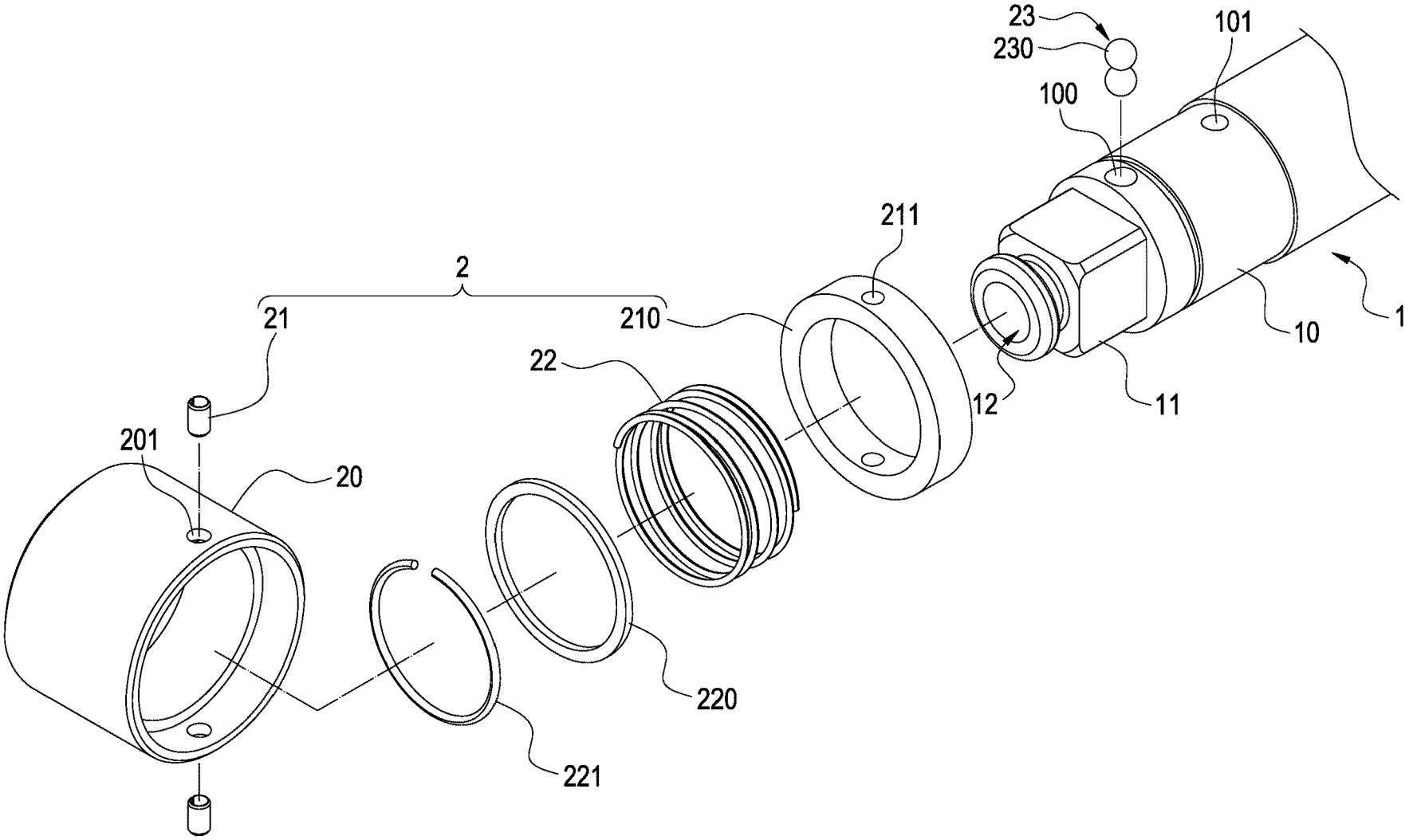
FIG. 1 is an exploded perspective view of the present invention.
Figure 2:
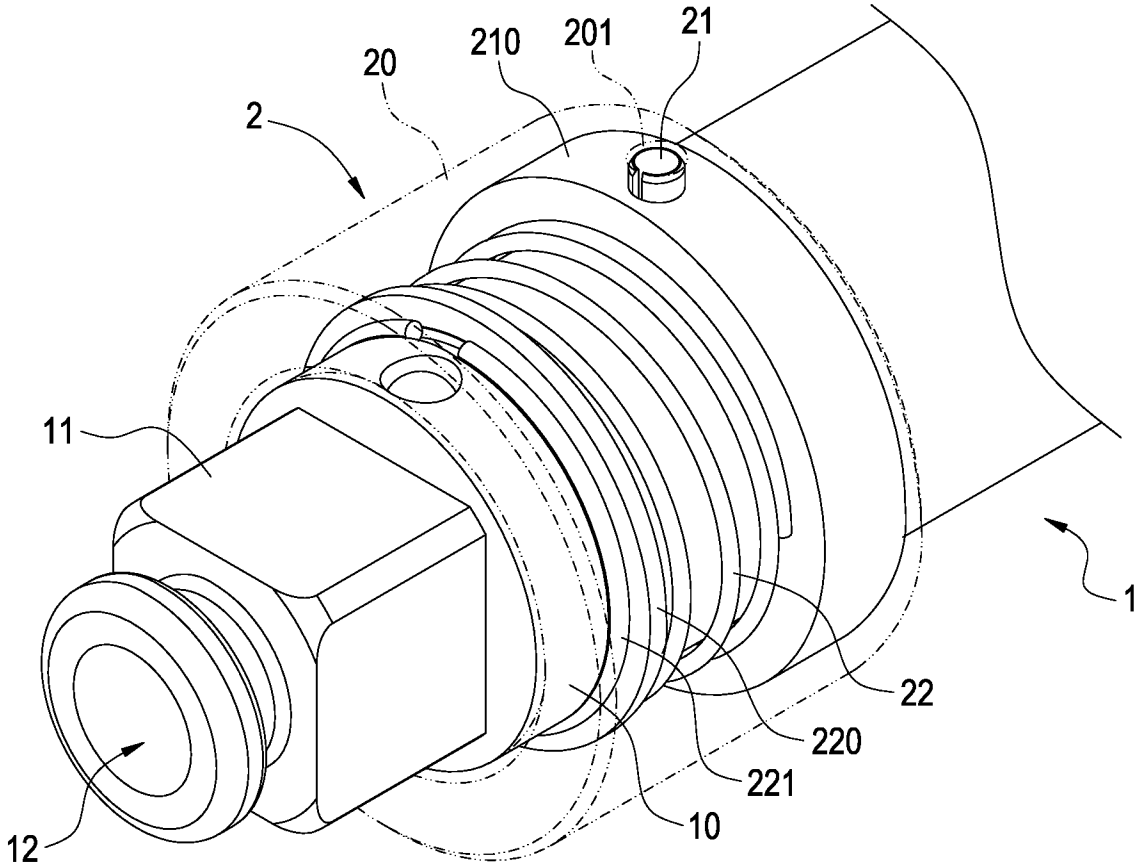
FIG. 2 is an assembly perspective view of the present invention.
Figure 3:
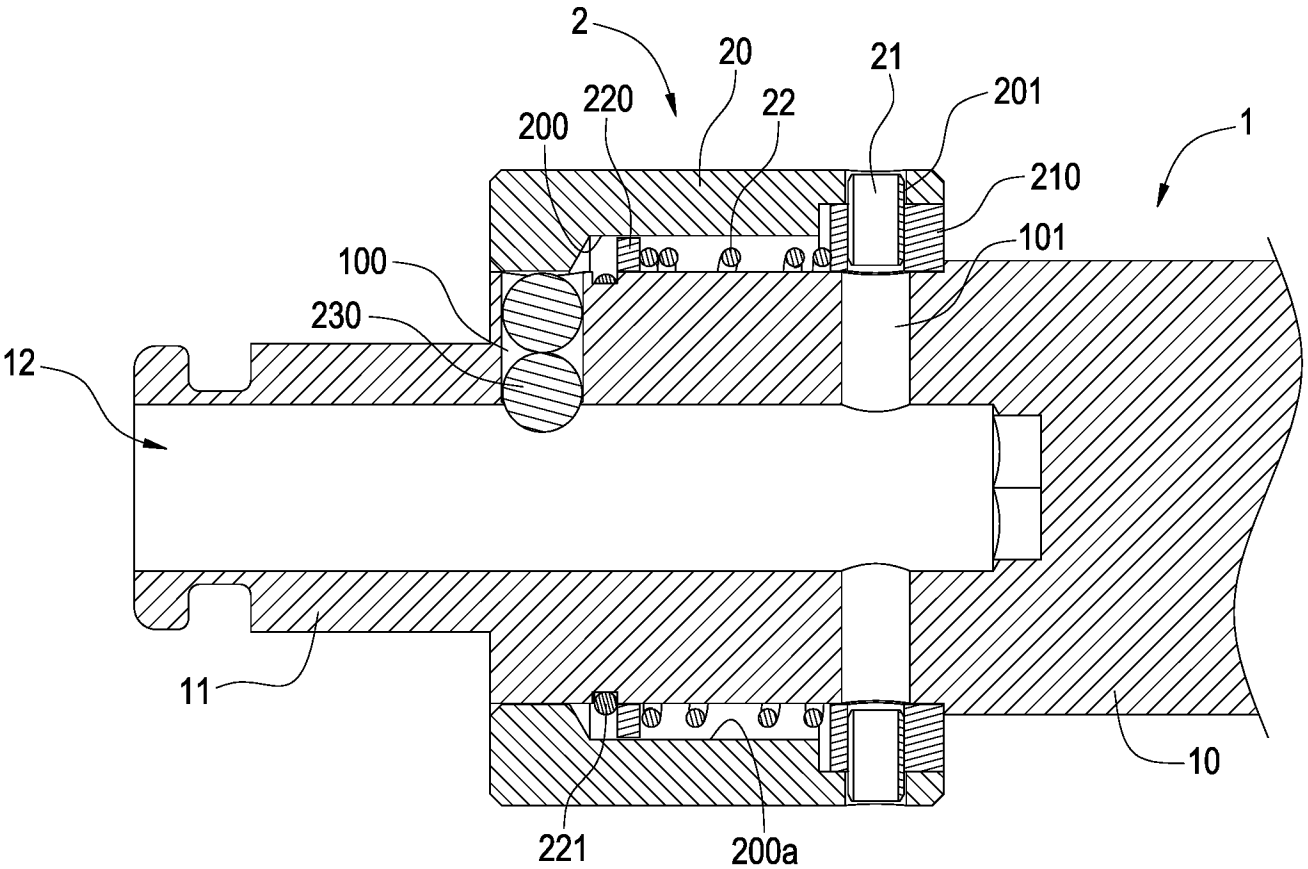
FIG. 3 is an assembly cross sectional view of the present invention.

Please refer to FIG. 1, FIG. 2 and FIG. 3, showing an exploded perspective view, an assembly perspective view and an assembly cross sectional view of the present invention. The present invention provides a tool adapter quick-release structure, comprising an adapter 1 and a locking mechanism 2.

Figure 4:
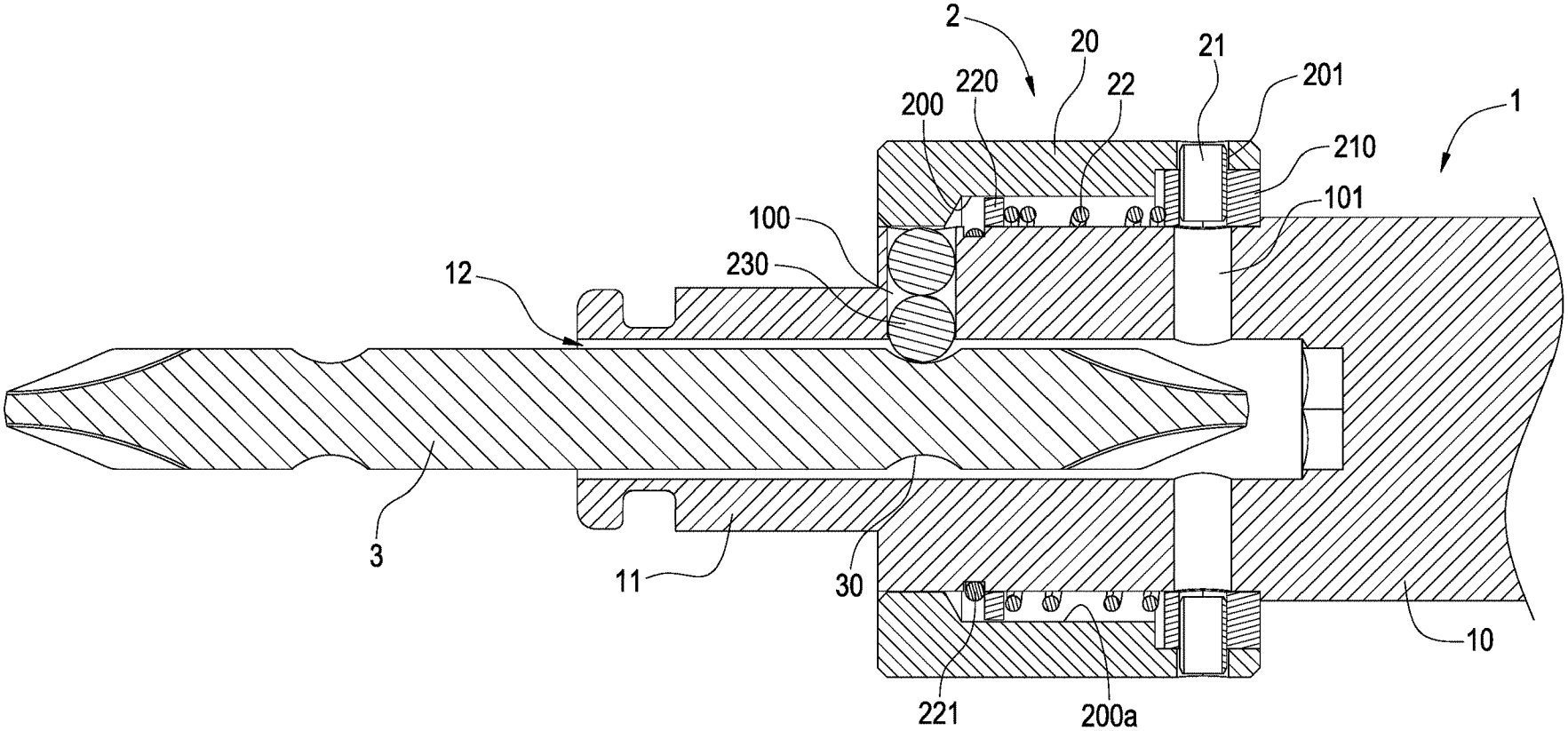
FIG. 4 is an assembly cross sectional view of the present invention having a screwdriver shaft attached thereto.

The adapter 1 is configured to be attached onto a handheld tool (not shown in the drawings) in order to facilitate the gripping and operation of a user. The adapter 1 includes a seat portion 10 and an engagement portion 11 extended forward from the seat portion 10, and an installation hole 12 formed to axially penetrate into an internal of the seat portion 10 via a front end of the engagement portion 11, in order to allow a screwdriver shaft 3 (as shown in FIG. 4) of any type of specification to be inserted into the installation hole 12 for use. In addition, an outer circumference of the engagement portion 11 can be of a polygonal shape, such as rectangular or hexagonal shape, in order to cooperate with other tools such that it can be provided for a sleeve of bolt or nut etc. having a corresponding polygonal shape for use. In an exemplary embodiment, the outer circumference of the engagement portion 11 is of a rectangular shape such that it can cooperate with a tool having a rectangular nut for installation onto the engagement portion 11, thereby facilitating the operation and use of the tool.

The locking mechanism 2 comprises a movable sleeve 20 axially mounted onto an exterior of the seat portion 10, an installation pin 21 radially inserted into the movable sleeve 20 and an elastic member 22 abutted against the installation pin 21 to push the movable sleeve 20 along an axial direction. In addition, the movable sleeve 20 is configured to allow a fixation member 23 to penetrate through the seat portion 10 in order to be partially protruded outward at an internal of the installation hole 12 via a push of the elastic member 22. In an exemplary embodiment of the present invention, the internal of the movable sleeve 20 includes a recessed slot 200 such that such that when the movable sleeve 20 is pushed forward, the fixation member 230 is able to retract into the recessed slot 200, thereby allowing the screwdriver shaft 3 (as shown in FIG. 4) to be inserted therein. Furthermore, once the screwdriver shaft is inserted to reach its engagement groove 30 and to align with the fixation member 23, the movable sleeve 20 is retracted. The fixation member 23 can be formed by one or a plurality of balls 230 arranged adjacent to each other and filled into the fixation hole 100 on the seat portion 10. Moreover, the recessed slot 200 can further include an accommodating slot 200*a* extended therefrom in order to allow the elastic member 22 to be received therein. One end of the elastic member 22 abuts against the installation pin 21 and another end thereof abuts against a retaining ring 220 mounted onto the exterior of the seat portion 10. The retaining ring 220 can be mounted onto the exterior of the seat portion 10 and uses a C-shape ring 221 locked onto the seat portion 10 to achieve retention.

According to the above, in an exemplary embodiment of the present invention, the installation pin 21 can be inserted into the movable sleeve 20 to form an integral part via a ring bracket 210. Furthermore, the movable sleeve 20 includes an outer insertion hole 201, and the ring bracket 210 also includes an inner insertion hole 211 formed corresponding thereto in order to allow the insertion pin 21 to be inserted between the inner and outer insertion holes 211, 201 such that it can be inserted into the movable sleeve 20 to form an integral part. Accordingly, the locking mechanism 2 can be installed onto the adapter 1 swiftly.

Figure 5:
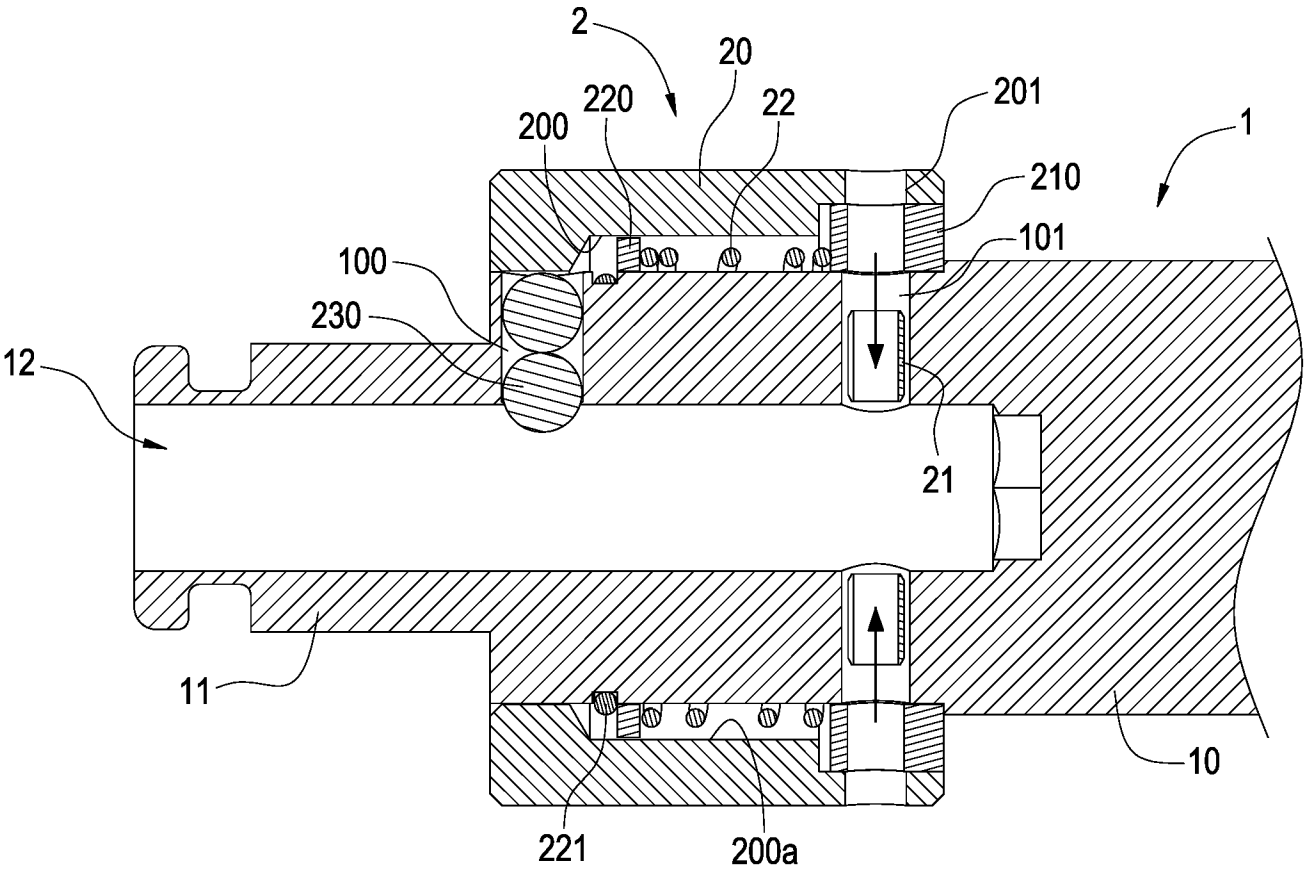
FIG. 5 is an assembly cross sectional view of the present invention during the removal process thereof.

As shown in FIG. 5, during the removal process, the aforementioned seat portion 10 of the present invention includes a repair hole 101, and the repair hole 101 is formed corresponding to the location of the installation pin 21 and is also radially connected to the internal of the installation hole 12. Accordingly, a user is only required to push the installation pin 21 toward the repair hole 101 to allow the repair hole 101 to fall within the installation hole 12, following which the installation pin 21 can be removed via the installation 12 extended to the engagement portion 11. In addition, since the movable sleeve 20 of the locking mechanism 2 are no longer under the positioning by the installation pin 21, it can be removed for repair or replacement of component parts with ease.

Accordingly, with the aforementioned structural assembly, a tool adapter quick-release structure can be obtained.

Figure 6:
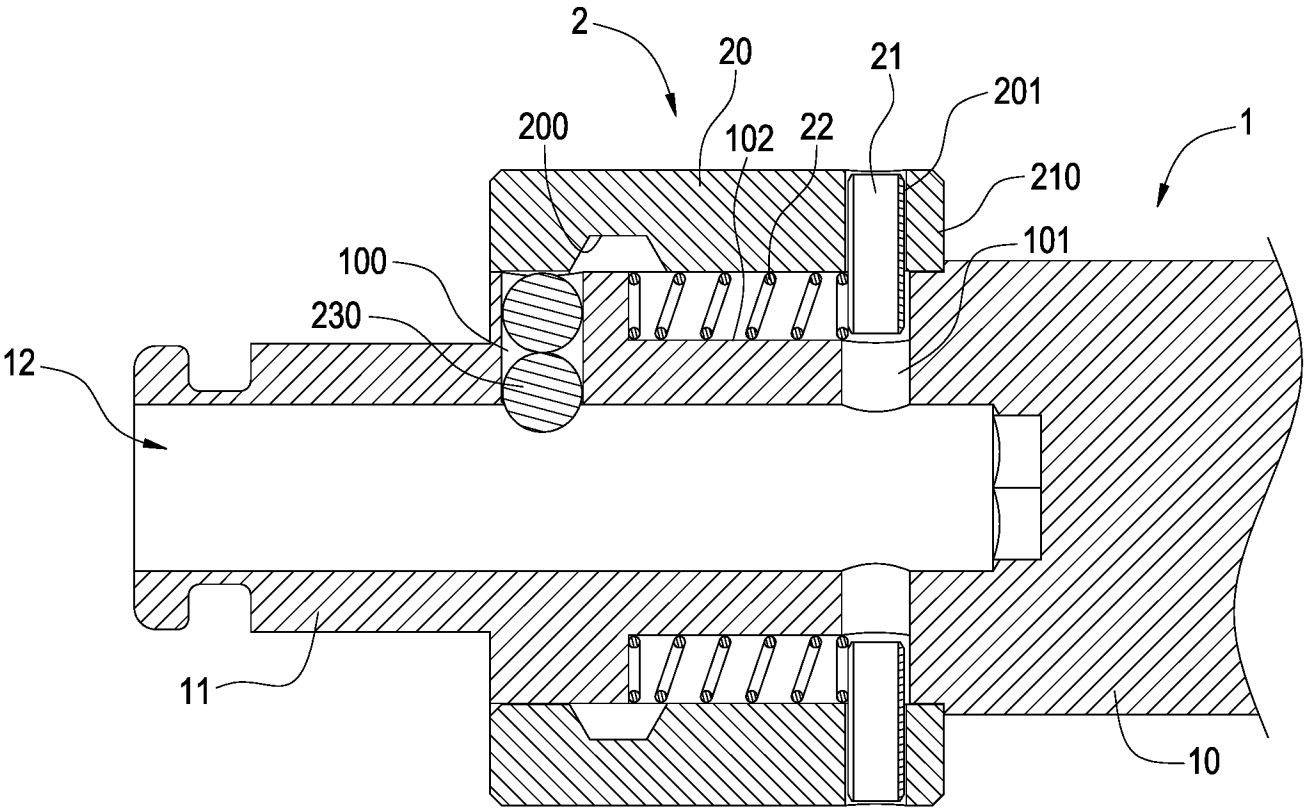
FIG. 6 is an assembly cross sectional view according to another exemplary embodiment of the present invention.
Figure 7:
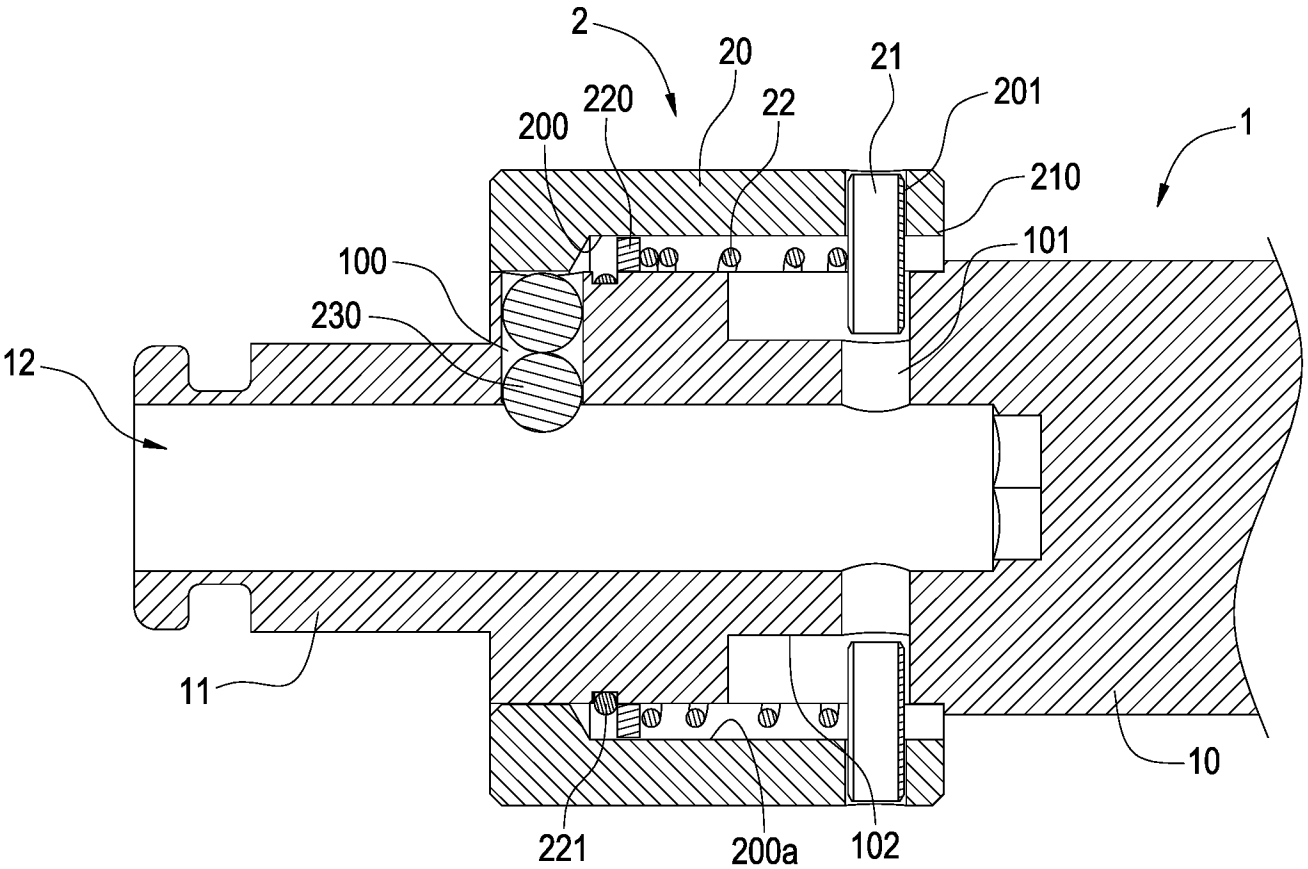
FIG. 7 is an assembly cross sectional view according to still another exemplary embodiment of the present invention.

Furthermore, FIG. 6 shows an assembly cross sectional view of another embodiment of the present invention. As shown in the drawing, the installation pin 21 can be further extended into the repair hole 101, and the seat portion 10 further includes an actuation slot 102 provided to receive the elastic element 22. In addition to allowing the elastic member 22 to abut against the installation pin 21, the actuation slot 102 can also provide a space necessary to accommodate the displacement of the installation pin 21 driven by the movable sleeve 20 moving axially on the seat portion 10. In addition, FIG. 7 shows an assembly cross sectional view of still another embodiment of the present invention. As shown in the drawing, the installation pin 21 can also have a configuration without the ring bracket 210, and similarly, it can further extend into the repair hole 101 and the seat portion 10 includes an actuation slot 102 formed thereon to provide a space necessary for a displacement thereof; however, the elastic member 22 is arranged inside the accommodating slot 200*a* extended from the recessed slot 200.

In view of the above, the present invention is able to achieve the expected objectives of use and to overcome the drawbacks of the prior arts. Therefore, the present invention is of novelty and inventive step, complying with the patentability for an invention patent. Accordingly, patent application is hereby filed according to the law in light of the grant of the patent right for the protection of the rights of the inventor.

The above describes the preferable and feasible exemplary embodiments of the present invention for illustrative purposes only, which shall not be treated as limitations of the scope of the present invention. Any equivalent changes and modifications made in accordance with the scope of the claims of the present invention shall be considered to be within the scope of the claim of the present invention.

What is claimed is:

1. A tool adapter quick-release structure, comprising:

an adapter having a seat portion and an engagement portion extended forward from the seat portion, and an installation hole formed to axially penetrate into an internal of the seat portion via the engagement portion;

a locking mechanism comprising a movable sleeve axially mounted onto an exterior of the seat portion, an installation pin radially inserted into the movable sleeve and an elastic member abutted against the installation pin to push the movable sleeve along an axial direction, and the movable sleeve configured to allow a fixation member to penetrate through the seat portion in order to be partially protruded outward at an internal of the installation hole via a push of the elastic member;

wherein the seat portion includes a repair hole formed corresponding to the installation pin, and the repair hole is connected to the installation hole, wherein the installation pin is inserted in the movable sleeve to form an integral part via a ring bracket.

2. The tool adapter quick-release structure according to claim 1, wherein the seat portion includes a fixation hole formed thereon in order to allow the fixation member to be filled into the fixation hole.

3. The tool adapter quick-release structure according to claim 1, wherein the fixation member is formed by one or a plurality of balls arranged adjacent to each other.

4. The tool adapter quick-release structure according to claim 1, wherein the installation pin extends into the repair hole, and the seat portion includes an actuation slot communicating with the repair hole and the elastic element is received in the actuation slot.

5. The tool adapter quick-release structure according to claim 1, wherein the installation pin extends into the repair hole, and the seat portion includes an actuation slot communicating with the repair hole to provide a moving space for the installation pin.

6. The tool adapter quick-release structure according to claim 1, wherein the movable sleeve includes a recessed slot such that when the movable sleeve is pushed forward, the fixation member retracts into the recessed slot.

7. The tool adapter quick-release structure according to claim 6, wherein the recessed slot further includes an accommodating groove extended therefrom in order to allow the elastic member to be received therein.

8. The tool adapter quick-release structure according to claim 7, wherein one end of the elastic member abuts against the installation pin and another end thereof abuts against a retaining ring mounted onto the exterior of the seat portion.

9. The tool adapter quick-release structure according to claim 8, wherein the retaining ring uses a C-shape ring locked onto the seat portion to achieve retention.

10. The tool adapter quick-release structure according to claim 1, wherein the movable sleeve includes an outer insertion hole, and the ring bracket also includes an inner insertion hole formed corresponding thereto; the insertion pin is inserted between the inner and outer insertion holes.

* * * * *